United States Patent [19]

Ullrich et al.

[11] Patent Number: 5,044,347

[45] Date of Patent: Sep. 3, 1991

[54] DEVICE PROMOTING THE DISPERSION OF FUEL WHEN ATOMIZED

[75] Inventors: Rolf Ullrich, Barrie; Eddy E. Glick, North York, both of Canada

[73] Assignee: 911105 Ontario Limited, Willowdale, Canada

[21] Appl. No.: 536,475

[22] Filed: Jun. 12, 1990

[51] Int. Cl.[5] ..... F02M 33/00

[52] U.S. Cl. ..... 123/538; 123/536

[58] Field of Search ..... 123/536, 537, 538, 3

[56] References Cited

U.S. PATENT DOCUMENTS

| | | | |
|---|---|---|---|
| 4,429,665 | 2/1984 | Brown | 123/3 |
| 4,715,325 | 12/1987 | Walker | 123/538 |
| 4,930,483 | 6/1990 | Jones | 123/538 |

*Primary Examiner*—Andrew M. Dolinar
*Assistant Examiner*—M. Macy
*Attorney, Agent, or Firm*—Smart & Biggar

[57] ABSTRACT

A device is disclosed for promoting the dispersion of fuel on atomization in order to permit more complete combustion. The device is installed in the fuel line proximate the fuel atomizer and comprises a core surrounded by a non-conductive sheath so as to provide channels through the device. The core is an alloy comprising over 50% copper, about 25% zinc, about 10% manganese, and over 5% nickel. The core is ridged to generate turbulence in the fuel in order to improve the exposure of the fuel to the core. Further, the configuration of the core may be chosen to provide a large surface area, again to improve the exposure of the fuel to the core.

16 Claims, 2 Drawing Sheets

DEVICE PROMOTING THE DISPERSION OF FUEL WHEN ATOMIZED

This invention relates to a core for a device promoting the dispersion of atomized fuel and to a device incorporating such a core.

In combustion engines, complete combustion of the fuel is desirable to maintain a high fuel efficiency and reduce emissions. Complete combustion depends in part on the degree of dispersion of the fuel in the combustion chamber. Currently, fuel is typically dispersed solely by atomization by means of jets feeding a carburetor or by means of fuel injectors feeding the combustion chamber. Atomization leaves droplets of fuel in the combustion chamber; dispersion of such droplets would be desirable.

A device is known which promotes the dispersion of fuel when atomized. This device comprises a copper tube containing an elongate core having a composition of nickel, copper, zinc, tin, and silver. The core forms a number of end-to-end channels in the copper tube. A piece of rubber hosing is worked over the copper tube to prevent grounding of the device. When this device is inserted in the fuel line of a combustion engine proximate the fuel atomizer, it promotes the dispersion of the fuel droplets on atomization of the fuel. The mechanism by which the device improves dispersion is not fully understood. It may be that the device polarizes or charges fuel molecules so that they have a net negative charge and therefore repel one another.

The subject invention seeks to avoid drawbacks of the known device.

Accordingly, the present invention comprises a core for a device promoting the dispersion of fuel when atomized comprising an alloy comprising copper, zinc, manganese, nickel, aluminum, iron, tin, lead, chromium, cobalt, titanium, magnesium, and molybdenum.

In another aspect, the present invention comprises a device promoting the dispersion of fuel when atomized comprising: an elongate core composed of an alloy including copper, zinc, manganese, nickel, aluminum, iron, tin, lead, chromium, cobalt, titanium, magnesium, and molybdenum; a non-conductive sheath surrounding the sides of said core; a plurality of end-to-end channels within said core or between said core and sheath; and means to couple the ends of said sheathed core to a fuel line proximate and upstream of a fuel atomizer.

In the figures which illustrate example embodiments of the invention:

FIG. 1*a* is a perspective view of the known prior art device;

FIG. 1*b* is a partially broken away perspective view of the core of the device of FIG. 1*a;*

Figure 3:
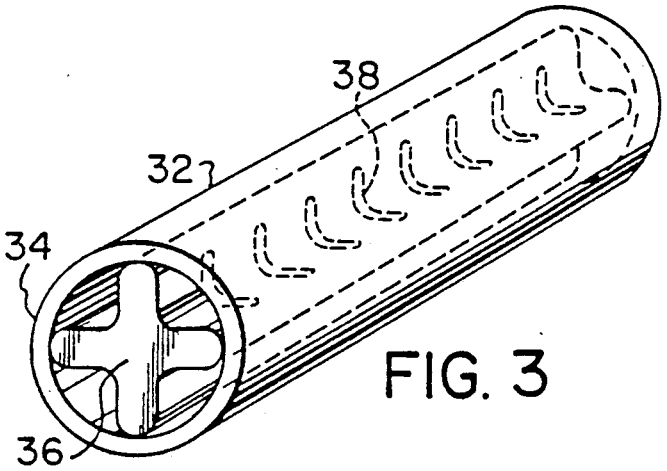
FIG. 3 is a perspective view of another core made in accordance with this invention.
Figure 3A:
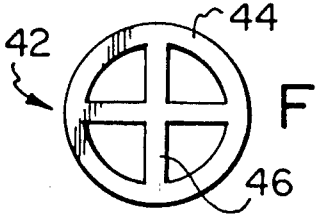
Figure 4:
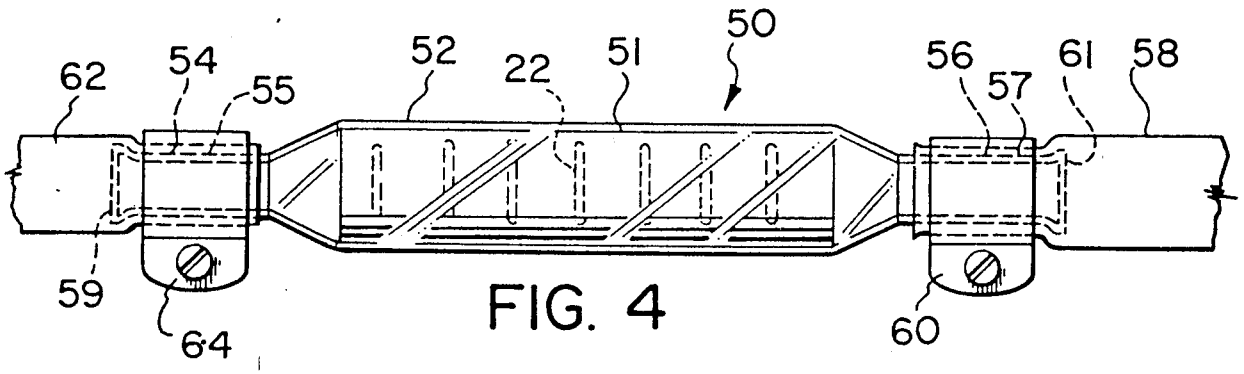

FIG. 3*a* is an end view of another core made in accordance with this invention; and FIG. 4 is a side view of a device made in accordance with this invention showing the device inserted in a fuel line.

Figure 1A:
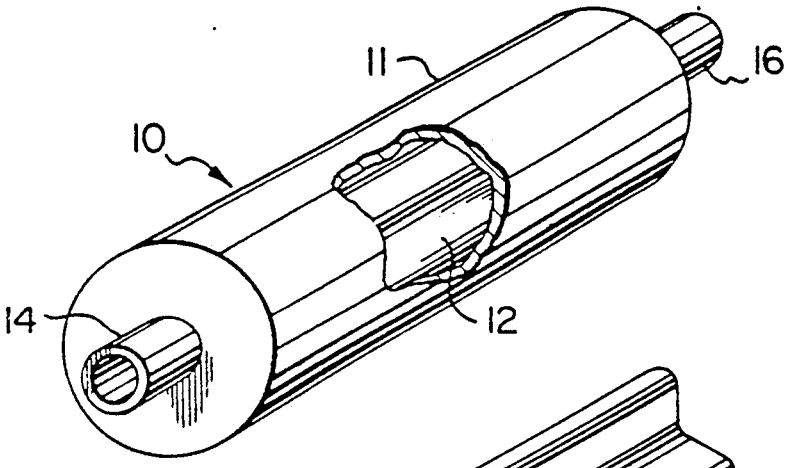
Figure 1B:
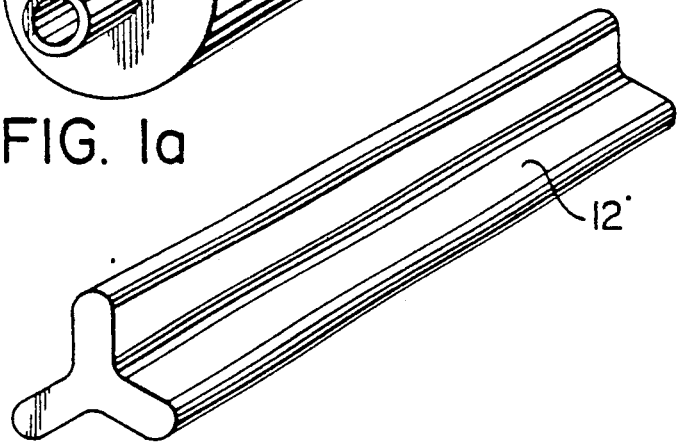

Turning to FIGS. 1*a* and 1*b*, the prior art device for promoting dispersion of fuel on atomization 10 comprises a copper tube 11 containing a core 12. The copper tube has reduced diameter ends 14 and 16 in order to retain the core in place within the tube and to provide points for connection of the device in a fuel line. The core is elongate and has a generally Y-shaped cross-section. The core and tube assembly provides three end-to-end channels in the tube, one channel between each side face of the core and the tube wall. The core is an alloy of nickel, copper, zinc, tin, and silver.

As aforenoted, when fuel is passed through the device, it may be that the fuel is polarized or charged so that the fuel molecules repel one another. This repulsion promotes dispersion of the fuel on atomization.

Through experimentation, it has been discovered that a core comprising the following alloy results in a device which dramatically improves the fuel efficiency of an internal combustion engine:

| metal | percent by weight |
|---|---|
| copper | 56.45 |
| zinc | 24.51 |
| manganese | 9.25 |
| nickel | 5.60 |
| aluminum | 1.31 |
| iron | 1.24 |
| lead | 0.55 |
| tin | 0.44 |
| magnesium | 0.02 |
| chromium | 0.01 |
| cobalt | less than 0.01 |
| titanium | less than 0.005 |
| molybdenum | less than 0.005 |

This alloy is referred to herein as the "full alloy". It is believed that at least copper, zinc, manganese, and nickel are needed for the core alloy in order that the device effectively promote dispersion of atomized fuel.

Figure 2:
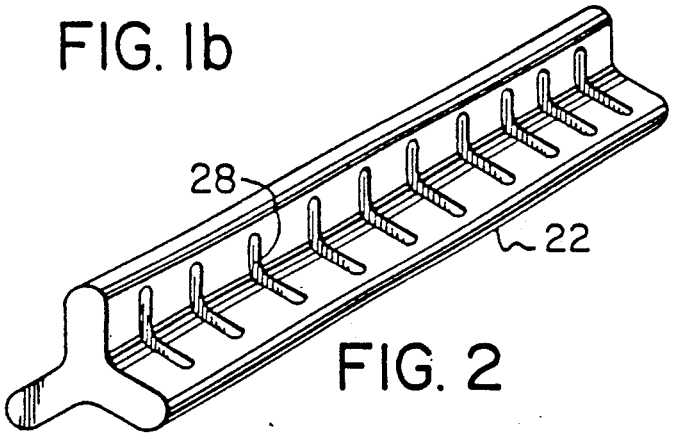
FIG. 2 is a perspective view of a core made in accordance with the subject invention.

It is believed that the effectiveness of the device is improved by exposing as much of the fuel passing through the device as possible to the core of the device. To this end, the core 22 of FIG. 2 has a plurality of ridges 28 along its length which ridges are on all three sides of the core. These ridges run transversely of the flow of the fuel through a device containing this core and promote turbulence in such fuel. Increasing the exposure of the fuel to the core may also be achieved by increasing the surface area of the core and this is accomplished with the core configuration 32 of FIG. 3. Core 32 has a cylindrical exterior portion 34 which receives a cruciate inner portion 36. Inner portion 36 slides into the cylindrical outer portion. The inner portion 36 has ridges 38 to promote turbulence in the fuel flowing through a device having this core.

In the modification of FIG. 3*a*, the core 42 has a cylindrical outer portion 44 which is integrally formed with the cruciate inner portion 46.

FIG. 4 illustrates a device 50 made in accordance with this invention for promoting dispersion of fuel on atomization connected into a fuel line. Device 50 comprises a tube 51 which receives the core 22 of FIG. 2. Tube 51 is coated with a non-conducting plastic material 52 which forms a sheath over the tube in order to avoid grounding of the device. The plastic sheath is made of a thermoplastic material to withstand the heat encountered proximate the combustion engine; one suitable thermoplastic is ABS TM . Tube 51 has reduced diameter end portions 54 and 56 having middle portions 55 and 57, respectively and ends 59 and 61, respectively. Ends 59 and 61 are of a slightly larger diameter than the mid portions 55 and 57. A fuel line 58 leading from a source of fuel is slid over end portion 56 of the tube and a hose clamp 60 clamps the end of the fuel line tightly to the mid portion 57 of the tube. Larger diameter end 61 blocks the hose clamp from slipping off the device. Similarly, the fuel line 62 leading to the fuel atomizer is clamped to the other end of the device by hose clamp 64. For maximum effect, the device should be installed proximate the atomizer.

Vehicle fuel lines are typically of two sizes and the ends 54 and 56 of the device have an intermediate size. Since fuel lines have some flexibility, the larger size of fuel line may be slipped over an end of the device 50 and compressed into a tight fit on the end by a hose clamp. Further, the fuel line of a smaller size may be worked onto an end of the device and, preferably, subsequently clamped.

Core 32 of FIG. 3 (and 42 of FIG. 3*a*) has the additional advantage that a non-conducting sheath may be placed directly on the cylindrical outer core 34 (44 of FIG. 3*a*) thereby avoiding the need for a tubular housing. A device similar to device 50 of FIG. 4 was constructed for field testing. This device had a core similar to the core 22 of FIG. 2 made of the aforedescribed full alloy. The following details the field tests which were conducted.

Test 1

The gasoline tank of a 1984 Oldsmobile Omega TM was filled to capacity and the mileage of the car recorded. The vehicle was then driven without the device on a 252 km course which ended where it began and the gasoline tank again filled to capacity. The vehicle required 33 liters of gasoline to fill the tank. The vehicle was then fitted with the device and driven on the same course the same day with similar weather conditions. At the end of the course, the vehicle required 24 liters of gasoline to fill the tank. Thus, the vehicle averaged 21 mpg without the device and 30 mpg with the device.

Tests 2 to 10 hereinbelow followed the same procedure as with this first test so that only the results of these subsequent tests are presented.

Test 2

A 1986 Honda Prelude TM driven on a 490 km course averaged 23 mpg without the device and 29 mpg with the device.

Test 3

A 1985 Volkswagen Jetta TM on a 360 km city course averaged 24 mpg without the device and 30 mpg with the device. The same vehicle on a 385 km highway course averaged 30 mpg without the device and 39 mpg with the device.

Test 4

A 1979 Ford Mark IV TM driven on a 2000 km course averaged 21 mpg without the device and 26 mpg with the device.

Test 5

A 1984 Mercury Topaz TM five speed driven on a 583 km course averaged 23 mpg without the device and 33 mpg with the device.

Test 6

A 1985 Volvo Turbo 760 TM on a 350 km course used 32.5 liters the device and 28 liters with the device.

Test 7

A 1985 Ford Escort TM diesel driven on a 2480 km course averaged 38 mpg without the device and 46 mpg with the device.

Test 8

A 1976 Ford TM 4×4 pick-up driven on a 610 km course averaged 12 mpg without the device and 18 mpg with the device.

Test 9

A 1988 Buick LaSabre TM driven on a 800 km course averaged 23 mpg without device and 30 mpg with the device.

Test 10

A 1985 GM TM V8 cube van driven on a 430 mile course managed 200 miles per tankful without the device and the entire course on one tank of gas with the device.

Plastic sheath 52 of FIG. 4 may be formed so as to have a hexagonal exterior; this facilitates installation of the device as the hexagonal shape may be easily gripped by hand or with a wrench. Other modifications within the spirit of the invention will be apparent to those skilled in the art.

We claim:

1. A core for a device promoting the dispersion of fuel when atomized comprising an alloy comprising copper, zinc, manganese, nickel, aluminum, iron, tin, lead, chromium, cobalt, titanium, magnesium, and molybdenum.

2. The core of claim 1 wherein the alloy comprises over 50% by weight copper and about 25% by weight zinc.

3. The core of claim 2 wherein the alloy comprises about 10% by weight manganese.

4. The core of claim 1 wherein the alloy comprises over 50% copper, about 25% zinc, about 10% manganese, and over 5% nickel.

5. The core of claim 4 wherein the alloy comprises over 0.1% of each of tin, lead, aluminum, and iron.

6. The core of claim 1 wherein said core is elongated and has uneven sides.

7. The core of claim 1 wherein said core comprises a cylindrical exterior enclosing an elongate inner member configured so that said core has a plurality of parallel channels running between the ends of the core.

8. The core of claim 7 wherein said inner member has a cruciate cross-section.

9. A device promoting the dispersion of fuel when atomized comprising:

(a) an elongate core composed f an alloy including copper, zinc, manganese, nickel, aluminum, iron, tin, lead, chromium, cobalt, titanium, magnesium, and molybdenum;

(b) a non-conductive sheath surrounding the sides of said core;

(c) a plurality of end-to-end channels within said core or between said core and sheath; and (d) means to couple the ends of said sheathed core to a fuel line proximate and upstream of a fuel atomizer.

10. The device of claim 9 wherein the alloy comprises over 50% by weight copper and about 25% by weight zinc.

11. The device of claim 10 wherein the alloy comprises about 10% by weight manganese.

12. The core of claim 9 wherein the alloy comprises over 50% copper, about 25% zinc, about 10% manganese, and over 5% nickel.

13. The core of claim 9 wherein the alloy comprises over 0.1% of each of tin, lead, aluminum, and iron.

14. The core of claim 9 wherein said core is elongate and has uneven sides.

15. The core of claim 9 wherein said core comprises a cylindrical exterior enclosing an elongate inner member configured so that said core has a plurality of parallel channels running between the ends of the core.

16. The core of claim 15 wherein said inner member has a cruciate cross-section.

* * * * *